United States Patent [19]

Klimpel et al.

[11] Patent Number: 4,822,483

[45] Date of Patent: Apr. 18, 1989

[54] COLLECTOR COMPOSITIONS FOR THE FROTH FLOTATION OF MINERAL VALUES

[75] Inventors: Richard R. Klimpel; Robert D. Hansen, both of Midland, Mich.

[73] Assignee: The Dow Chemical Company, Midland, Mich.

[21] Appl. No.: 28,855

[22] Filed: Mar. 23, 1987

Related U.S. Application Data

[63] Continuation-in-part of Ser. No. 856,728, Apr. 28, 1986, Pat. No. 4,684,459, which is a continuation-in-part of Ser. No. 803,026, Nov. 29, 1985, abandoned, which is a continuation-in-part of Ser. No. 787,199, Oct. 15, 1985, abandoned, which is a continuation-in-part of Ser. No. 649,890, Sep. 13, 1984, abandoned.

[51] Int. Cl.[4] ..... B03D 1/02

[52] U.S. Cl. ..... 209/167; 209/166; 252/61; 260/404.5; 564/152; 564/201; 564/215; 564/224; 564/511

[58] Field of Search ..... 252/61; 209/166, 167; 260/404.5 R, 404.5 EU; 564/152, 201, 215, 224, 511

[56] References Cited

U.S. PATENT DOCUMENTS

| | | | |
|---|---|---|---|
| 1,364,307 | 1/1921 | Perkins et al. | 209/166 |
| 2,093,470 | 8/1942 | Mead et al. | 209/166 |
| 2,120,217 | 6/1938 | Harris | 209/166 |
| 2,177,985 | 10/1939 | Harris | 209/166 |
| 2,278,107 | 3/1942 | Jayne, Jr. et al. | 209/166 |
| 2,312,414 | 3/1943 | Jayne, Jr. et al. | 209/166 |
| 2,387,201 | 10/1945 | Weiner | 260/404.5 |
| 2,389,763 | 11/1945 | Cahn | 209/166 |
| 2,569,417 | 9/1951 | Jayne et al. | 260/404.5 |
| 2,578,790 | 12/1951 | Duke | 209/166 |
| 2,970,140 | 1/1961 | Hullinger et al. | 209/166 |
| 3,006,471 | 10/1961 | Luttinger | 209/166 |
| 3,370,704 | 2/1968 | Baarson et al. | 209/166 |
| 3,414,617 | 12/1968 | Bresson et al. | 260/570.5 |
| 3,414,620 | 12/1968 | Bresson et al. | 260/584 |
| 3,426,896 | 2/1969 | Baarson et al. | 209/167 |
| 3,609,189 | 9/1971 | Bresson et al. | 260/561 |
| 3,906,042 | 9/1975 | Bresson et al. | 260/559 |
| 3,975,295 | 8/1976 | Koch | 252/357 |
| 4,070,276 | 1/1978 | Broman et al. | 209/166 |
| 4,102,781 | 7/1978 | Tenbergen | 209/166 |
| 4,148,926 | 4/1979 | Baker et al. | 260/404.5 |
| 4,174,274 | 11/1979 | Tolley et al. | 209/166 |
| 4,275,847 | 6/1981 | Bahr et al. | 241/20 |
| 4,295,962 | 10/1981 | Parlman et al. | 209/167 |
| 4,394,257 | 7/1983 | Wang et al. | 252/61 |
| 4,684,459 | 8/1987 | Klimpel et al. | 252/61 |

FOREIGN PATENT DOCUMENTS

| | | |
|---|---|---|
| 1136073 | 5/1957 | France . |
| 2489714 | 9/1980 | France . |
| 421177 | 12/1981 | Sweden . |

*Primary Examiner*—Robert Wax

[57] ABSTRACT

A collector composition for use in froth flotation processes comprises two collectors. One of the collectors is preferably an N-(hydrocarbyl)-alpha, omega-alkanediamine, an (omega-aminoalkyl) hydrocarbon amide or mixture thereof. The second collector is a thiocarbonate, a thionocarbamate, a thiophosphate, thiocarbinilide, thiophosphinate, mercaptan, xanthogen formate, xanthic ester or mixture thereof. The collector composition floats a broad range of metal-containing minerals.

25 Claims, No Drawings

COLLECTOR COMPOSITIONS FOR THE FROTH FLOTATION OF MINERAL VALUES

CROSS-REFERENCE TO RELATED APPLICATIONS

This application is a continuation-in-part of copending application Ser. No. 856,728 filed Apr. 28, 1986, now U.S. Pat. No. 4,684,459, which is a continuation-in-part of copending application Ser. No. 803,026, filed Nov. 29, 1985, now abandoned which is a continuation-in-part of copending application Ser. No. 787,199 filed Oct. 15, 1985, now abandoned, which is a continuation-in-part of copending application Ser. No. 649,890, filed Sept. 13, 1984, now abandoned.

BACKGROUND OF THE INVENTION

This invention relates to compositions useful as collectors for the recovery of metal-containing mineral from ores by froth flotation.

Flotation is a process of treating a mixture of finely divided mineral solids, e.g., a pulverulent ore, suspended in a liquid whereby a portion of such solids is separated from other finely divided mineral solids, e.g., clays and other like materials present in the ore, by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes adherence of some gas to certain suspended solids and not to others and makes the particles having the gas thus adhered thereto lighter than the liquid. Accordingly, these particles rise to the top of the liquid to form a froth. The phenomena which renders flotation a particularly valuable industrial operation appear to be largely associated with the selective affinity of the surface of particulated solids, suspended in a liquid containing entrapped gas, for the liquid on the one hand, the gas on the other.

Various flotation agents have been admixed with the suspension to improve the frothing process. Such added agents are classed according to the function to be performed and include collectors such as xanthates, thionocarbamates and the like; frothers which facilitate the forming of a stable froth such as natural oils, e.g., pine oil and eucalyptus oil; modifiers such as activators, e.g., copper sulfate, to induce flotation in the presence of a collector; depressants, e.g., sodium cyanide, which tend to prevent a collector from functioning as such on a mineral which it is desired to retain in the liquid, and thereby discourage a substance from being carried up and forming a part of the froth; pH regulators to provide optimum metallurgical results, e.g., lime and soda ash and the like. The specific additives used in a flotation operation are selected according to the nature of the ore, the mineral sought to be recovered and the other additives which are to be used in combination therewith.

Flotation is employed in a number of mineral separation processes including the selective separation of such metal-containing minerals as copper, zinc, lead, nickel, molybdenum and other metals from sulfide minerals containing primarily iron, e.g., pyrite and pyrrhotite.

The conversion of metal-containing minerals to the more useful pure metal state is often achieved by smelting processes. Such smelting processes can result in the formation of volatile sulfur compounds. These volatile sulfur compounds are often released to the atmosphere through smokestacks, or are removed from such smokestacks by expensive and elaborate scrubbing equipment. Many nonferrous metal-containing minerals are formed naturally in the presence of sulfide minerals containing primarily iron, such as pyrite and pyrrhotite. When the iron-containing sulfide minerals are recovered in flotation processes along with the nonferrous metal-containing sulfide minerals and sulfidized metal-containing oxide minerals, there is excess sulfur present which is released in the smelting processes. Therefore, processes which selectively recover the nonferrous metal-contaning minerals while minimizing the recovery of the sulfide minerals containing primarily iron are desired.

Among others, collectors commonly used for the recovery of the metal-containing sulfide mineral ores or sulfidized metal-containing oxide minerals are xanthates, dithiophosphates, and thionocarbamates. Unfortunately, the xanthates, thionocarbamates, and dithiophosphates are not particularly selective in the recovery of nonferrous metal-containing sulfide minerals in the presence of sulfide minerals containing primarily iron. In addition, these collectors are not generally of a commercially acceptable quality in the recovery of oxide-containing mineral values.

Of the other collectors, the mercaptan collectors are very slow kinetically in the flotation of metal-containing sulfide minerals and the disulfides and polysulfides give relatively low recoveries with slow kinetics. Therefore, the mercaptans, disulfides and polysulfides are again not particularly selective in the recovery of nonferrous metal-containing sulfide minerals in the presence of sulfide minerals containing primarily iron.

In view of the foregoing, collectors which are useful for the recovery, at relatively good recovery rates and selectivities, of a broad range of metal-containing minerals from mineral ores, particularly metal-containing minerals from ores in the presence of sulfide minerals containing primarily iron are desired.

SUMMARY OF THE INVENTION

The present invention, in one aspect, is a composition comprising (a) a compound corresponding to the formula:

$$R^1-X-(R)_n-Q \qquad (I)$$

wherein $-(R)_n-$ is

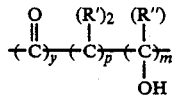

each R′ and R″ is independently hydrogen, methyl or ethyl; y+p+m=n; n is an integer from 1 to 6; y and m are independently 0 or 1; p is an integer from 1 to 6 and each moiety can occur in random sequence; $R^1$ is a $C_{1-22}$ hydrocarbyl or a $C_{1-22}$ substituted hydrocarbyl; —X— is

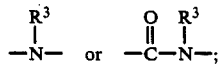

$R^3$ is hydrogen, a $C_{1-22}$ hydrocarbyl or a $C_{1-22}$ substituted hydrocarbyl; and Q is:

—$N(R^2)_2$ and each $R^2$ is independently hydrogen, a $C_{1-22}$ hydrocarbyl or $C_{1-22}$ substituted hydrocarbyl, —N═Y where Y is S, O, a hydrocarbylene radical or a substituted hydrocarbylene radical, —C≡N, or —N (cyclic ring)

where the cyclic ring is saturated or unsaturated and may contain additional heteroatoms, such as oxygen or sulfur or additional nitrogen atoms; and (b) a thiol compound selected from the group consisting of a thiocarbonate, thionocarbamate, thiocarbanilide, thiosphosphate, thiophosphinates, mercaptan, xanthogen formate, a xanthic ester and mixtures thereof.

In another aspect, the invention resides in a method for recovering metal-containing minerals from an ore which comprises subjecting the ore, in the form of an aqueous pulp, to a froth flotation process in the presence of a flotation collector under conditions such that the metal-containing mineral(s) are recovered in the froth, wherein the collector comprises the above-described composition.

The compositions of this invention are capable of floating broad range of metal-containing minerals including metal-containing sulfide minerals, metal-containing oxide minerals, sulfidized metal-containing oxide minerals and metals occurring in the metallic state (all four mineral groups being referred to herein as metal-containing minerals) from ores by froth flotation. The collector compositions of the present invention provide higher recoveries and selectivity towards the desired mineral than can be achieved with the use of either collector component alone, particularly in the recovery of nonferrous metal-containing minerals and a higher selectivity toward such nonferrous metal-containing minerals when such metal-containing minerals are found in the presence of sulfide minerals containing primarily iron.

DETAILED DESCRIPTION OF THE INVENTION

Component (a) of the composition of this invention is a component having structural formula (I). Although not specifically set forth in formula (I), in aqueous medium of low pH, preferably acidic, component (a) can exist in the form of a salt. In this formula, $\text{-}(R)\text{-}_n$ is advantageously:

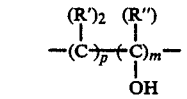

wherein m is 0 or 1, more preferably 0 and p is an integer from 1 to 6, preferably from 1 to 4, most preferably 2 or 3. If substituted, $R^1$ and each substituted $R^2$ group is substituted with one or more hydroxy, amino, phosphonyl, alkoxy, halo, ether, imino, carbamyl, carbonyl, thiocarbonyl, cyano, carboxyl, hydrocarbylthio, hydrocarbyloxy, hydrocarbylamino or hydrocarbylimino groups. Q is preferably N—$(R^2)_2$.

Most advantageously, the number of carbon atoms in $R^1$ and $R^2$ total 6 or more and $R^1$ is preferably a $C_{2-14}$ hydrocarbyl or a $C_{2-14}$ hydrocarbyl substituted with one or more hydroxy, carbonyl, amino, phosphonyl or alkoxy groups, more preferably a $C_{4-11}$ hydrocarbyl; and one $R^2$ is hydrogen and the other $R^2$ is preferably a $C_{1-6}$ alkyl, a $C_{1-6}$ alkylcarbonyl or a $C_{1-6}$ substituted alkyl or alkylcarbonyl group; more preferably a $C_{1-4}$ alkyl, $C_{1-4}$ alkylcarbonyl or a $C_{1-4}$ alkylcarbonyl substituted with an amino, hydroxy or phosphonyl group; and most preferably hydrogen or a $C_{1-2}$ alkyl or $C_{1-2}$ alkylcarbonyl. X is preferably $NR^3$; and $R^3$ is preferably hydrogen or $C_{1-4}$ hydrocarbyl, more preferably hydrogen or $C_{1-11}$ hydrocarbyl, most preferably hydrogen.

As described, the component (a) includes compounds such as the N-(hydrocarbyl)-alpha,omega-alkanediamines:

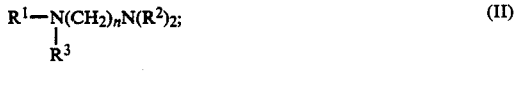

(II)

and the N-(omega-aminoalkyl) hydrocarbon amides:

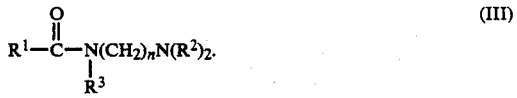

(III)

The N-(omega-aminoalkyl) hydrocarbon amides can be prepared by the processes described in Fazio, U.S. Pat. No. 4,326,067 (relevant parts incorporated herein by reference); *Acta Polon Pharm,* 19, 277 (1962) (incorporated herein by reference); and *Beilstein,* 4, 4th Ed., 3rd Supp., 587 (1962) (incorporated herein by reference). The N-(hydrocarbyl)-alpha,omega-alkanediamines can be prepared by the process well-known in the art. One example is the process described in East German Pat. No. 98,510 (incorporated herein by reference).

The second component (b) of the collector composition of this invention is a thiol compound selected from the group consisting of thiocarbonate, thionocarbamate, thiocarbanilide, thiophosphate, thiophosphinates, mercaptan, xanthogen formate, xanthic ester and mixtures thereof.

Preferred thiocarbonates are the alkyl thiocarbonates represented by the structural formula:

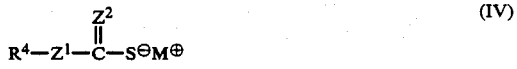

(IV)

wherein each $R^4$ is independently a $C_{1-20}$, preferably $C_{2-16}$, more preferably $C_{3-12}$ alkyl group; $Z^1$ and $Z^2$ are independently a sulfur or oxygen atom; and $M^+$ is an alkali metal cation.

The compounds represented by formula IV include the alkyl thiocarbonates (both $Z^1$ and $Z^2$ are oxygen), alkyl dithiocarbonates ($Z^1$ is 0, $Z^2$ is S) and the alkyl trithiocarbonates (both $Z^1$ and $Z^2$ are sulfur).

Examples of preferred alkyl monothiocarbonates include sodium ethyl monothiocarbonate, sodium isopropyl monothiocarbonate, sodium isobutyl monothiocarbonate, sodium amyl monothiocarbonate, potassium ethyl monothiocarbonate, potassium isopropyl monothiocarbonate, potassium isobutyl monothiocarbonate, and potassium amyl monothiocarbonate. Preferred alkyl dithiocarbonates include potassium ethyl dithiocarbonate, sodium ethyl dithiocarbonate, potassium amyl dithiocarbonate, sodium amyl dithiocarbonate, potassium isopropyl dithiocarbonate, sodium isopropyl dithiocarbonate, sodium sec-butyl dithiocarbonate, potassium sec-butyl dithiocarbonate, sodium isobutyl dithiocarbonate, potassium isobutyl dithiocarbonate, and the like. Examples of alkyl trithiocarbonates include sodium isobutyl trithiocarbonate and potassium isobutyl trithiocarbonate. It is often preferred to employ a mixture of an alkyl monothiocarbonate, alkyl dithiocarbonate and alkyl trithiocarbonate.

Preferred thionocarbamates correspond to the formula

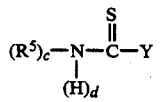

(V)

wherein each $R^5$ is independently a $C_{1-10}$, preferably a $C_{1-4}$, more preferably a $C_{1-3}$, alkyl group; Y is $—S^{-M+}$ or $—OR^6$, wherein $R^6$ is a $C_{1-10}$, preferably a $C_{2-6}$, more preferably a $C_{3-4}$, alkyl group; c is the integer 1 or 2; and d is the integer 0 or 1, wherein c+d must equal 2.

Preferred thionocarbamates include dialkyl dithiocarbamates (c=2, d=0 and Y is $S^-M^+$) and alkyl thionocarbamates (c=1, d=1 and Y is $—OR^6$). Examples of preferred dialkyl dithiocarbamates include methyl butyl dithiocarbamate, methyl isobutyl dithiocarbamate, methyl sec-butyl dithiocarbamate, methyl propyl dithiocarbamate, methyl isopropyl dithiocarbamate, ethyl butyl dithiocarbamate, ethyl isobutyl dithiocarbamate, ethyl sec-butyl dithiocarbamate, ethyl propyl dithiocarbamate, and ethyl isopropyl dithiocarbamate. Examples of preferred alkyl thionocarbamates include N-methyl butyl thionocarbamate, N-methyl isobutyl thionocarbamate, N-methyl sec-butyl thionocarbamate, N-methyl propyl thiionocarbamate, N-methyl isopropyl thionocarbamate, N-ethyl butyl thionocarbamate, N-ethyl isobutyl thionocarbamate, N-ethyl sec-butyl thionocarbamate, N-ethyl propyl thionocarbamate, and N-ethyl isopropyl thionocarbamate. Of the foregoing, N-ethyl isopropyl thionocarbamate and N-ethyl isobutyl thionocarbamate are most preferred.

Thiophosphates useful herein generally correspond to the formula

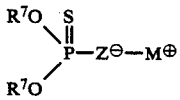

(VI)

wherein each $R^7$ is independently hydrogen or a $C_{1-10}$ alkyl, preferably a $C_{2-8}$ alkyl, or an aryl, preferably an aryl group having from 6–10 carbon atoms, more preferably cresyl; Z is oxygen or sulfur; and M is an alkali metal cation.

Of these compounds of the formula VI, those preferably employed include the monoalkyl dithiophosphates (one $R^7$ is hydrogen and the other $R^7$ is a $C_{1-10}$ alkyl and Z is S), dialkyl dithiophosphates (both $R^7$ are $C_{1-10}$ alkyl and Z is S) and dialkyl monothiophosphate (both $R^7$ are a $C_{1-10}$ alkyl and Z is 0).

Examples of preferred monoalkyl dithiophosphates include sodium ethyl dithiophosphate, sodium propyl dithiophosphate, sodium isopropyl dithiophosphate, sodium butyl dithiophosphate, sodium sec-butyl dithiophosphate, and sodium isobutyl dithiophosphate. Examples of dialkyl or aryl dithiophosphates include sodium diethyl dithiophosphate, sodium di-sec-butyl dithiophosphate, sodium diisobutyl, dithiophosphate, and sodium diisoamyl dithiophosphate. Preferred monothiophosphates include sodium diethyl monothiophosphate, sodium di-sec-butyl monothiophosphate, sodium diisobutyl monothiophosphate, and sodium diisoamyl monothiophosphate.

Thiocarbanilides (dialkyl thioureas) are represented by the general formula:

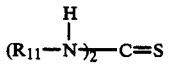

(VII)

wherein each $R_{11}$ is individually H or a $C_{1-6}$, preferably a $C_{1-3}$, hydrocarbyl.

Thiophosphinates are represented by the general structural formula:

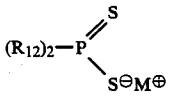

(VIII)

wherein $M^{\oplus}$ is as hereinbefore described and each $R_{12}$ is independently an alkyl or aryl group, preferably an alkyl group having from 1 to 12, more preferably an alkyl group having from 1 to 8 carbon atoms. Most preferably, each $R_{12}$ is isobutyl.

Mercaptan collectors are preferably alkyl mercaptans represented by the general structural formula:

$$R_{13}—S—H \quad \text{(IX)}$$

wherein $R_{13}$ is an alkyl group, preferably an alkyl group having at least 10, more preferably from 10 to 16, carbon atoms.

Xanthogen formates are represented by the general structural formula:

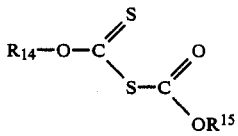

(X)

wherein $R_{14}$ is an alkyl group having from 1 to 7, preferably from 2 to 6 carbon atoms and $R_{15}$ is an alkyl group having 1 to 6, preferably 2 to 4, more preferably 2 or 3, carbon atoms.

Xanthic esters are preferably compounds of the general structural formula:

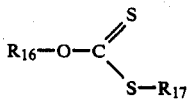

(XI)

wherein $R_{16}$ is an allyl group and $R_{17}$ is an alkyl group having from 1 to 7 carbon atoms.

Preferred compounds for use as component (b) herein are the thiocarbonates, thionocarbamates and the thiosphosphates due to the surprisingly high recoveries and selectivities towards mineral values which can be achieved.

The composition of the present invention is prepared using sufficient amounts of component (a) and component (b) to prepare an effective collector for metal-containing mineral from ores in a froth flotation process. The amounts of each component most advantageously employed in preparing the composition will vary depending on the specific ore being treated and the desired rates of recovery and selectivity. The composition preferably comprises from about 10 to about 90, more preferably from 20 to 80, percent by weight, of component (a), and from about 10 to about 90, more preferably from 20 to 80, percent by weight, of component (b). The composition of this invention even more preferably comprises from about 30 to about 70 percent by weight of component (a) and from about 30 to about 70 percent by weight of component (b).

Within these compositional limitations, the amount of components (a) and (b) are selected such that the recovery of metal value in a froth flotation process is higher than either component could recover at the same weight dosage.

A particularly preferred composition of the present invention comprises (a) an N-(hydrocarbyl)-alpha,omega-alkanediamine, an N-(omega-aminoalkyl)-hydrocarbon amide or mixtures thereof; and (b) an alkyl thiocarbonate, preferably a mixture comprising an alkyl monothiocarbonate, an alkyl dithiocarbonate and an alkyl trithiocarbonate.

The composition and process of this invention are useful for the recovery by froth flotation of metal-containing minerals from ores. An ore refers herein to the metal as it is taken out of the ground and includes the metal-containing minerals in admixture with the gangue. Gangue refers herein to those materials which are of no value and need to be separated from the metal values.

Ores for which the composition and process are useful include the sulfide mineral ores containing copper, zinc, molybdenum, cobalt, nickel, lead, arsenic, silver, chromium, gold, platinum, uranium and mixtures thereof. Examples of metal-containing sulfide minerals which may be concentrated by froth flotation using the composition and process of this invention include copper-bearing minerals such as covellite ($CuS$), chalcocite ($Cu_2S$), chalcopyrite ($CuFeS_2$), bornite ($Cu_5FeS_4$), valleriite ($Cu_2Fe_4S_7$ or $Cu_3Fe_4S_7$), tetrahedrite ($Cu_3SbS_2$), enargite ($Cu_3(As_2Sb)S_4$), tennantite ($Cu_{12}As_4S_{13}$), cubanite ($Cu_2SFe_4S_5$), brochantite ($Cu_4(OH)_6SO_4$), and antlerite ($Cu_3SO_4(OH)_4$), famatinite ($Cu_3(SbAs)S_4$), and bournonite ($PbCuSbS_3$); lead-bearing minerals such as galena ($PbS$); antimony-bearing minerals such as stibnite ($Sb_2S_3$); zinc-bearing minerals such as sphalerite ($ZnS$); silver-bearing minerals such as stephanite ($Ag_5SbS_4$), and argentite ($Ag_2S$); chromium-bearing minerals such as daubreelite ($FeSCrS_3$); nickel-bearing minerals such as pentlandite [$(FeNi)_9S_8$]; molybenum-bearing minerals such as molybdenite ($MoS_2$); and platinum- and palladium-bearing minerals such as cooperite ($Pt(AsS)_2$). In the recovery of metal-containing sulfide minerals, the composition and method of this invention are particularly preferred in the recovery of molybdenite ($MoS_2$), chalcopyrite ($CuFeS_2$), galena ($PbS$), sphalerite ($ZnS$), bornite ($Cu_5FeS_4$), and pentlandite [$(FeNi)_9S_8$].

Sulfidized metal-containing oxide minerals are minerals which are treated with a sulfidization chemical, so as to give such minerals sulfide mineral characteristics, so the minerals can be recovered in froth flotation using collectors which recover sulfide minerals. Sulfidization results in oxide minerals having sulfide mineral characteristics. Oxide minerals are sulfidized by contact with compounds which react with the minerals to form a sulfur bond or affinity. Such methods are well-known in the art. Such compounds include sodium hydrosulfide, sulfuric acid and related sulfur-containing salts such as sodium sulfide.

Sulfidized metal-containing oxide minerals and oxide minerals for which this process is useful include oxide minerals containing copper, aluminum, iron, titanium, magnesium, chromium, tungsten, molybdenum, manganese, tin, uranium and mixtures thereof. Examples of metal-containing minerals which may be concentrated by froth flotation using the composition and process of this invention include copper-bearing minerals such as tenorite ($CuO$), malachite ($Cu_2(OH)_2CO_3$), cuprite ($Cu_2O$), atacamite ($Cu_2Cl(OH)_3$), chrysocolla ($CuSiO_3$), azurite ($Cu_3(OH)_2(CO_3)_2$); aluminum-bearing minerals such as corundum; zinc-containing minerals such as zincite ($ZnO$), and smithsonite ($ZnCO_3$); tungsten-containing minerals such as wolframite [$(Fe_2Mn)WO_4$]; nickel-bearing minerals such as bunsenite ($NiO$); molybdenum-bearing minerals such as wulfenite ($PbMoO_4$) and powellite ($CaMoO_4$); iron-containing minerals such as hematite and magnetite; chromium-containing minerals such as chromite ($FeOCr_2O_3$); iron- and titanium-containing minerals such as ilmenite; magnesium- and aluminum-containing minerals such as spinel; titanium-containing minerals such as rutile; manganese-containing minerals such as pyrolusite; tin-containing minerals such as cassiterite; and uranium-containing minerals such as uraninite, pitchblende ($U_2O_5$-($U_3O_8$)) and gummite ($UO_3nH_2O$).

Other metal-containing minerals for which this process is useful include gold-bearing minerals such as sylvanite ($AuAgTe_2$) and calaverite ($AuTe$); platinum- and palladium-bearing minerals, such as sperrylite ($PtAs_2$); and silver-bearing minerals, such as hessite ($AgTe_2$). Also included are metals which occur in a metallic state, e.g., gold, silver and copper.

In a preferred embodiment of this invention, copper-containing sulfide minerals, nickel-containing sulfide minerals, lead-containing sulfide minerals, zinc-containing sulfide minerals or molybdenum-containing sulfide minerals are recovered. In an even more preferred embodiment, a copper-containing sulfide mineral is recovered.

The collector composition of this invention can be used in any concentration which gives the desired recovery of the desired metal values. In particular, the concentration used is dependent upon the particular mineral to be recovered, the grade of the ore to be subjected to the froth flotation process and the desired quality of the mineral to be recovered. Preferably, the collector composition of this invention is used in a concentration of from 5 grams (g) to 1000 g per metric ton of ore, more preferably from about 10 g to 200 g of collector per metric ton of ore to be subjected to froth flotation. In general, to obtain optimum performance from the collectors, it is most advantageous to begin at low dosage levels and increase the dosage level until the desired effect is achieved.

During the froth flotation process of this invention, the use of frothers is preferred. Frothers are well-known in the art and reference is made thereto for the purposes of this invention. Examples of such frothers include $C_{5-8}$ alcohols, pine oils, cresols, $C_{1-4}$ alkyl ethers of polypropylene glycols, dihydroxylates of polypropylene glycols, glycols, fatty acids, soaps, alkylaryl sulfonates and the like. Furthermore, blends of such frothers may also be used. All frothers which are suitable for beneficiation of mineral ores by froth flotation can be used in this invention.

In addition, in the process of this invention it is contemplated that the collector combination which makes up the composition of this invention can be used in mixtures with other collectors well-known in the art.

The collector composition of this invention may also be used with an amount of other collectors known in the art which give the desired recovery of mineral values. Examples of such other collectors useful in this invention include thiophosphonyl chlorides, mercapto benzothiazoles, fatty acids and salts of fatty acids, alkyl sulfuric acids and salts thereof, alkyl and alkaryl sulfonic acids and salts thereof, alkyl phosphoric acids and salts thereof, alkyl and aryl phosphoric acids and salts thereof, sulfosuccinates, sulfosuccinamates, primary amines, secondary amines, tertiary amines, quaternary ammonium salts, alkyl pyridinium salts, and guanidine. In addition, the collector composition of the present invention can be employed with the S-(omega-aminoalkyl) hydrocarbon thioates, the omega-(hydrocarbylthio)alkylamines, the omega-(hydrocarbyloxy)alkylamines and the omega-aminoalkyl hydrocarbonates such as described in U.S. patent application Ser. No. 649,890, filed Sept. 13, 1984.

The following examples are included for the purposes of illustration only and are not to be construed to limit the scope of the invention or claims. Unless otherwise indicated, all parts and percentages are by weight.

In the following example, the performance of the frothing processes described is shown by giving the amount of recovery at a specified time.

EXAMPLE 1

A series of samples of copper/nickel ore, containing chalcopyrite and pentlandite minerals, from Eastern Canada having a high amount of iron sulfide in the form of pyrrhotite are drawn from feeders to plant rougher bank and placed in buckets. Each bucket holds approximately 1200 g of solid. The contents of each bucket which has a pH of about 9 are used to generate a series of time-recovery profiles using the various collectors set forth in Table I. The profiles are made using a Denver® cell equipped with an automated paddle and constant pulp level device. A frother and collector are added once with a condition time of one minute before froth removal is started. The dosage of the collectors is 0.028 kg/ton of flotation feed. A Dowfroth® 1263 frother is also employed at a concentration of 0.0028 kg/ton. During the testing, individual concentrates are selected at 1, 3, 6 and 12 minutes for subsequent evaluation. The collected concentrates are dried, weighed, ground and statistically representative samples prepared for assay. Time-related recoveries and overall head grades are calculated using standard calculation procedures. Results are presented in Table I.

TABLE I

| Collector | Cu R-12[2] | Ni R-12[2] | Gangue R-12[2] | Pyrrhotite R-12[2] |
|---|---|---|---|---|
| sodium amyl xanthate[1] | 0.939 | 0.842 | 0.039 | 0.333 |
| N,N—dibutyl-1,2-ethane diamine[1] | 0.926 | 0.849 | 0.042 | 0.473 |
| N,N—dibutyl-1,2-ethane diamine (75 weight percent) and sodium amyl xanthate (25 weight percent) | 0.957 | 0.883 | 0.062 | 0.466 |
| nonyl N—(2-aminoethyl)amide[1] | 0.900 | 0.814 | 0.034 | 0.400 |
| nonyl N—(2-aminoethyl)-amide (75 weight percent) and sodium amyl xanthate (25 weight percent) | 0.937 | 0.872 | 0.037 | 0.369 |

[1]Not an example of the invention.
[2]R-12 is the fractional recovery after 12 minutes.

As evidenced by the data set forth in Table I, the composition of the present invention which comprises a collector combination results in superior recovery in the froth flotation process as compared to the froth flotation process using a single collector.

What is claimed is:

1. A composition comprising (a) a compound corresponding to the formula:

$$[R^1—X—(R)_n—Q]$$

$$R^1—X—(R)_n—N(R^2)_2$$

wherein $—(R)_n—$ is

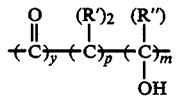

each R′ and R″ is independently hydrogen, methyl or ethyl; $y+p+m=n$; n is an integer from 1 to 6; y and m are independently 0 or 1; and $y+m=0$ or 1; p is an integer from 1 to 6 and each moiety can occur in random sequence; $R^1$ is a $C_{1-22}$ hydrocarbyl or a $C_{1-22}$ substituted hydrocarbyl; each $R^2$ is independently hydrogen, a $C_{1-22}$ hydrocarbyl or $C_{1-22}$ substituted hydrocarbyl; and —X— is

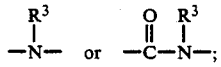

$R^3$ is hydrogen, a $C_{1-22}$ hydrocarbyl or a $C_{1-22}$ substituted hydrocarbyl; and (b) a thiol compound selected from the group consisting of a thiocarbonate, thionocarbamate, thiocarbanilide, thiophosphate, thiophosphinates, mercaptan, xanthogen formate, a xanthic ester and mixtures thereof.

2. The composition of claim 1 wherein component (a) and component (b) are employed in amounts such that the composition is an effective collector for mineral from ore in a froth flotation process.

3. The composition of claim 1 wherein y=0, m=0 and p is an integer from 1 to 6, $R^1$ is a $C_{2-14}$ hydrocarbyl or a $C_{2-14}$ hydrocarbyl substituted with one or more hydroxyl, amino, carbonyl, phosphonyl or alkoxy moieties, one $R^2$ is hydrogen and the other $R^2$ is hydrogen, a $C_{1-6}$ alkyl, $C_{1-6}$ alkylcarbonyl, or a $C_{1-6}$ alkyl or alkylcarbonyl substituted with an amino, hydroxy or phosphonyl moiety.

4. The composition of claim 3 wherein component (b) is an alkyl thiocarbonate of the structural formula:

$$R^4-Z^1-\overset{\overset{\displaystyle Z^2}{\|}}{C}-S^{\ominus}M^{\oplus};$$

a thionocarbamate of the structural formula:

$$(R^5)_c-\underset{\underset{\displaystyle (H)_d}{|}}{N}-\overset{\overset{\displaystyle S}{\|}}{C}-Y;$$

a thiophosphate of the structural formula:

$$\begin{array}{l} R^7O \quad S \\ \quad\ \diagdown \ \| \\ \quad\ \ P-Z^{\ominus}-M^{\oplus}; \\ \quad\ \diagup \\ R^7O \end{array}$$

or mixtures thereof and $R^4$ is a $C_{1-20}$ alkyl group; each $R^5$ is independently a $C_{1-10}$ alkyl group; Y is $-S^{-M+}$ or $-OR^6$; $R^6$ is a $C_{1-10}$ alkyl group; each $R^7$ is independently hydrogen, a $C_{1-10}$ alkyl group or an aryl group; $M^+$ is an alkali metal cation; Z, $Z^1$ and $Z^2$ are independently S or O; c is the integer 1 or 2; and d is the integer 0 or 1, with the proviso that the sum of c plus d equal 2.

5. The composition of claim 4 wherein component (a) is an N-(hydrocarbyl)-alpha, omega-alkanediamine; (omega-aminoalkyl) hydrocarbon amide; or mixture thereof.

6. The composition of claim 5 which comprises (a) from about 10 to about 90 percent by weight of N-(hydrocarbyl)-alpha,omega-alkanediamine, (omega-aminoalkyl) hydrocarbon amide, or mixture thereof; and (b) from about 10 to about 90 percent by weight of an alkyl thiocarbonate, thionocarbamate, thiophosphate or mixture thereof.

7. The composition of claim 6 which comprises (a) from about 20 to about 80 percent by weight of an N-(hydrocarbyl)-alpha,omega-alkanediamine, an (omega-aminoalkyl) hydrocarbon amide, or mixture thereof; and (b) from about 20 to about 80 percent by weight of an alkyl thiocarbonate, thionocarbamate, thiophosphate or mixture thereof.

8. The composition of claim 7 wherein $R^1$ is $C_{2-14}$ hydrocarbyl; one $R^2$ is hydrogen and the other $R^2$ is hydrogen, a $C_{1-6}$ alkyl or $C_{1-6}$ alkylcarbonyl; $R^3$ is hydrogen or $C_{1-14}$ hydrocarbyl; $R^4$ is $C_{2-16}$ alkyl; $R^5$ is $C_{1-4}$ alkyl; $R^6$ is $C_{2-6}$ alkyl; $R^7$ is cresyl or $C_{2-8}$ alkyl; M is sodium or potassium; and p is an integer of from 1 to 4.

9. The composition of claim 8 wherein $R^1$ is $C_{4-11}$ hydrocarbyl, one $R^2$ is hydrogen and the other $R^2$ is hydrogen, a $C_{1-4}$ alkyl or $C_{1-4}$ alkylcarbonyl; $R^3$ is hydrogen or $C_{1-11}$ hydrocarbyl; p is the integer 2 or 3; X is —NR3—; $R^4$ is $C_{3-12}$ alkyl; $R^5$ is $C_{1-3}$ alkyl; and $R^6$ is $C_{3-4}$ alkyl.

10. The composition of claim 9 wherein component (b) of the collector composition is an alkyl thiocarbonate.

11. The composition of claim 10 wherein component (b) comprises a mixture of an alkyl monothiocarbonate, alkyl dithiocarbonate and alkyl trithiocarbonate.

12. A method of recovering metal from a metal ore which comprises subjecting the metal ore, in the form of an aqueous pulp, to a froth flotation process in the presence of a flotating amount of the flotation collector composition of claim 1.

13. The method of claim 12 wherein component (a) is an N-(hydrocarbyl)-alpha,omega-alkanediamine, an (omega-aminoalkyl) hydrocarbon amide, or mixture thereof and components (a) and (b) are employed in amounts such that the composition is an effective collector for mineral values in a froth flotation process.

14. The method of claim 13 wherein component (b) is an alkyl thiocarbonate corresponding to the structural formula:

$$R^4-Z^1-\overset{\overset{\displaystyle Z^2}{\|}}{C}-S^{\ominus}M^{\oplus};$$

a thionocarbamate of the structural formula:

$$(R^5)_c-\underset{\underset{\displaystyle (H)_d}{|}}{N}-\overset{\overset{\displaystyle S}{\|}}{C}-Y;$$

a thiophosphate of the structural formula:

$$\begin{array}{l} R^7O \quad S \\ \quad\ \diagdown \ \| \\ \quad\ \ P-Z^{\ominus}-M^{\oplus}; \\ \quad\ \diagup \\ R^7O \end{array}$$

and $R^4$ is a $C_{1-20}$ alkyl group; each $R^5$ is independently a $C_{1-10}$ alkyl group; Y is $-S^{-M+}$ or $-OR^6$; $R^6$ is a $C_{1-10}$ alkyl group; each $R^7$ is independently hydrogen, a $C_{1-10}$ alkyl group or an aryl group; M is an alkali metal cation; Z, $Z^1$ and $Z^2$ are independently S or O; c is the integer 1 or 2; and d is the integer 0 or 1, with the proviso that the sum of c plus d equal 2.

15. The method of claim 13 wherein the collector comprises (a) from about 10 to about 90 percent by weight of an N-(hydrocarbyl)-alpha,omega-alkanediamine, an (omega-aminoalkyl) hydrocarbon amide, or mixture thereof; and (b) from about 10 to about 90 percent by weight of an alkyl thiocarbonate, thionocarbamate, thiophosphate or mixture thereof.

16. The method of claim 15 wherein the collector comprises (a) from about 20 to about 80 percent by weight of an N-(hydrocarbyl)-alpha,omega-alkanediamine, an (omega-aminoalkyl) hydrocarbon amide, or mixture thereof; and (b) from about 20 to about 80 percent by weight of an alkyl thiocarbonate, thionocarbamate, thiophosphate or mixture thereof.

17. The method of claim 16 wherein $R^4$ is $C_{2-16}$ alkyl; $R^5$ is $C_{1-4}$ alkyl; $R^6$ is $C_{2-6}$ alkyl; $R^7$ is hydrogen or $C_{2-8}$ alkyl; and M is sodium or potassium.

18. The method of claim 17 wherein $R^4$ is $C_{3-12}$ alkyl; $R^5$ is $C_{1-3}$ alkyl; and $R^6$ is $C_{3-4}$ alkyl.

19. The method of claim 18 wherein component (b) of the collector composition is an alkyl thiocarbonate.

20. The method of claim 19 wherein component (b) comprises a mixture of an alkyl monothiocarbonate, alkyl dithiocarbonate and alkyl trithiocarbonate.

21. The method of claim 12 wherein a metal-containing sulfide mineral is recovered in the froth.

22. The method of claim 21 wherein a metal-containing sulfide mineral recovered in the froth contains copper, zinc, molybdenum, cobalt, nickel, lead, arsenic, silver, chromium, gold, platinum, uranium or mixture thereof.

23. The method of claim 22 wherein the metal-containing sulfide mineral recovered in the froth is molybdenite, chalcopyrite, galena, sphalerite, bornite, or pentlandite.

24. The method of claim 23 wherein the collector composition is present in a concentration of from about 0.001 kg of collector/ton to about 1.0 kg of collector/-ton of feed to flotation.

25. The composition of claim 1 wherein $R^1$ is a $C_{1-22}$ hdyrocarbyl or a $C_{1-22}$ hydrocarbyl substituted with one or more hydroxy, amino, phosponyl, alkoxy, imino, carbamyl, carbonyl, cyano, carboxyl, hydrocarbylthio, hydrocarbyloxy, hydrocarbylamino or hydrocarbylimino groups and each $R^2$ group is independently hydrogen, a $C_{1-22}$ hydrocarbyl or a $C_{1-22}$ hydrocarbyl substituted with one or more hydroxy, amino, phosponyl, alkoxy, imino, carbamyl, carbonyl, cyano, carboxyl, hydrocarbylthio, hydrocarbyloxy, hydrocarbylamino or hydrocarbylimino groups.

* * * * *

UNITED STATES PATENT AND TRADEMARK OFFICE

CERTIFICATE OF CORRECTION

PATENT NO. : 4,822,483

DATED : April 18, 1989

INVENTOR(S) : Richard R. Klimpel and Robert D. Hansen

It is certified that error appears in the above-identified patent and that said Letters Patent is hereby corrected as shown below:

Column 1, line 54, "provide" should read -- produce --.

Column 2, line 15, "metal-contaning" should read -- metal-containing --.

Column 3, line 17, "thiosphosphate" should read -- thiophosphate --.

Column 3, line 27, "floating broad" should read -- floating a broad --.

Column 4, line 9, "$C_{1-4}$" should read -- $C_{1-14}$ --.

Column 5, line 35, "thiionocarbamate" should read -- thionocarbamate --.

Column 6, line 1, "diisobutyl, dithiophosphate" should read -- diisobutyl dithiophosphate --.

Column 6, lines 40 through 45, in the formula, "$OR^{15}$" should read -- $OR_{15}$ --.

UNITED STATES PATENT AND TRADEMARK OFFICE

CERTIFICATE OF CORRECTION

PATENT NO. : 4,822,483

DATED : April 18, 1989

INVENTOR(S) : Richard R. Klimpel and Robert D. Hansen

It is certified that error appears in the above-identified patent and that said Letters Patent is hereby corrected as shown below:

Column 6, line 63, "thiosphosphates" should read -- thiophosphates --.

Column 7, line 45, "($Cu_4(OH)_6SO_4$), and antlerite" should read -- ($Cu_4(OH)_6SO_4$), antlerite --.

Column 7, line 54, "molybenum-bearing" should read -- molybdenum-bearing --.

Column 8, line 58, "collectors" should read -- collector --.

Column 10, line 62, "hydroxyl" should read -- hydroxy --.

Column 14, line 4, "hdyrocarbyl" should read -- hydrocarbyl --.

Column 14, line 5, "phosponyl" should read -- phosphonyl --.

UNITED STATES PATENT AND TRADEMARK OFFICE

CERTIFICATE OF CORRECTION

PATENT NO. : 4,822,483

DATED : April 18, 1989

INVENTOR(S) : Richard R. Klimpel, et al

It is certified that error appears in the above-identified patent and that said Letters Patent is hereby corrected as shown below:

Column 14, line 10, "phosponyl" should read --phosphonyl --.

Signed and Sealed this

Fourteenth Day of August, 1990

*Attest:*

HARRY F. MANBECK, JR.

*Attesting Officer*

*Commissioner of Patents and Trademarks*